US007980308B2

(12) United States Patent
Myers, Jr. et al.

(10) Patent No.: US 7,980,308 B2
(45) Date of Patent: Jul. 19, 2011

(54) PERFORATING GUN ASSEMBLY AND METHOD FOR CONTROLLING WELLBORE FLUID DYNAMICS

(75) Inventors: William D. Myers, Jr., Spring, TX (US); Alphie S. Wright, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 918 days.

(21) Appl. No.: 11/602,107

(22) Filed: Nov. 20, 2006

(65) Prior Publication Data

US 2008/0115943 A1 May 22, 2008

(51) Int. Cl.
*E21B 29/02* (2006.01)
*E21B 43/11* (2006.01)

(52) U.S. Cl. ..... 166/297; 166/55.1

(58) Field of Classification Search ..... 166/297, 166/55.1; 175/4.54, 4.52, 4.55
See application file for complete search history.

(56) References Cited

U.S. PATENT DOCUMENTS

| | | | | |
|---|---|---|---|---|
| 2,191,781 | A | 2/1940 | Turechek | |
| 2,371,391 | A * | 3/1945 | Haynes | 166/51 |
| 2,513,944 | A * | 7/1950 | Kessler | 166/278 |
| 4,363,366 | A * | 12/1982 | Hilty | 175/314 |
| 4,605,074 | A * | 8/1986 | Barfield | 175/4.52 |
| 4,656,944 | A * | 4/1987 | Gonzalez | 102/312 |
| 5,076,355 | A | 12/1991 | Donovan et al. | |
| 5,088,557 | A | 2/1992 | Ricles et al. | |
| 5,234,055 | A * | 8/1993 | Cornette | 166/278 |
| RE34,451 | E | 11/1993 | Donovan et al. | |
| 5,327,974 | A | 7/1994 | Donovan et al. | |
| 5,394,938 | A * | 3/1995 | Cornette et al. | 166/51 |
| 6,325,146 | B1 * | 12/2001 | Ringgenberg et al. | 166/250.17 |
| 6,598,682 | B2 * | 7/2003 | Johnson et al. | 166/370 |
| 6,675,893 | B2 * | 1/2004 | Lund | 166/278 |
| 6,732,798 | B2 | 5/2004 | Johnson et al. | |
| 6,796,381 | B2 | 9/2004 | Ayler et al. | |
| 6,877,561 | B2 | 4/2005 | Richard et al. | |

OTHER PUBLICATIONS (Authors unknown), "Dynamic Underbalance" Technique for Increased Productivity, www.slb.com/oilfield, Jul. 2003.

* cited by examiner

*Primary Examiner* — William P Neuder
*Assistant Examiner* — Robert E Fuller
(74) *Attorney, Agent, or Firm* — Bracewell & Giuliani LLP

(57) ABSTRACT

A downhole tool used in the pressure isolation of adjacent subterranean formations. The downhole tool may comprise flow restriction devices along the outer circumference for impeding flow along the length of the tool. The tool may further comprise a perforating gun and an accumulator. Impeding flow along the length of the tool provides a dynamic flow restriction within the wellbore that precludes fluid flowing from one subterranean zone to an adjacent zone.

17 Claims, 5 Drawing Sheets

PERFORATING GUN ASSEMBLY AND METHOD FOR CONTROLLING WELLBORE FLUID DYNAMICS

BACKGROUND OF THE INVENTION

1. Field of the Invention

The invention relates generally to the field of oil and gas production. More specifically, the present invention relates to a perforating system. Yet more specifically, the present invention relates to a perforating gun system capable of controlling wellbore fluid dynamics.

2. Description of Related Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 an example of a perforating system 4 is shown. For the sake of clarity, the system 4 depicted comprises a single perforating gun 6 instead of a multitude of guns. The gun 6 is shown disposed within a wellbore 1 on a wireline 5. The perforating system 4 as shown also includes a service truck 7 on the surface 9, where in addition to providing a raising and lowering means, the wireline 5 also provides communication and control connectivity between the truck 7 and the perforating gun 6. As is known, derricks, slips and other similar systems may be used for inserting and retrieving the perforating system into and from a wellbore. Moreover, perforating systems may also be disposed into a wellbore via tubing, drill pipe, slick line, coiled tubing, to mention a few.

Included with the perforating gun 6 are shaped charges 8 that typically include a housing, a liner, and a quantity of high explosive inserted between the liner and the housing. When the high explosive is detonated, the force of the detonation collapses the liner and ejects it from one end of the charge 8 at very high velocity in a pattern called a "jet" 12. The jet 12 perforates the casing and the cement and creates a perforation 10 that extends into the surrounding formation 2.

As shown in FIG. 2, subsequent to the perforating step, formation fluid flows from the formation 2, into the wellbore 1, and through the annulus 11 formed by the outer circumference of the perforating gun 6 and the inner diameter of the wellbore 1 (the direction of this fluid flow is illustrated by arrows A). Fluid flows from the formation 2 into the wellbore 1 because the wellbore pressure is exceeded by the formation pressure, this is commonly referred to as an under-balanced situation. Debris 14 from the formation however often travels along with the fluid, this debris 14 can sometimes collect within the annulus 11 and in certain locations thereby resulting in a clog 16 that can effectively lodge the perforating gun 6 within the wellbore 1. The connate fluid is shown flowing from within a first zone $Z_1$, into the wellbore 1 into zone $Z_2$. This presents a problem if it is desired to maintain these separate zones ($Z_1$, $Z_2$) at separate pressures.

BRIEF SUMMARY OF THE INVENTION

An embodiment of the present invention involves a perforating system comprising, a perforating portion, and a zonal isolation system. The zonal isolation system is disposed along the perforating portion. The perforating system of claim 1, wherein the zonal isolation system comprises a flow restriction device. The flow restriction device may include an auger flight, an orifice plate, and combinations thereof. Optionally, the perforating system may further comprise an accumulator section. The perforating system may further comprise a reservoir disposed within the accumulator section, with optional ports.

Also disclosed herein is a downhole tool comprising, a body, a wellbore insertion and retrieval system attachable to the body, and a subterranean zonal isolation system included with the body. The downhole tool may optionally include a zonal isolation system comprises a flow restriction member. The flow restriction member may be an auger flight, an orifice plate, an accumulator, and combinations thereof. The accumulator may be a fluid reservoir. The flow restriction member may be an auger flight, an orifice plate, an accumulator, and combinations thereof. The downhole tool may also include a second zonal isolation system.

Included is a method of dynamically isolating a first subterranean formation zone from a second subterranean formation zone within a wellbore. The method comprises disposing a downhole pressure isolation tool having a flow restriction member within the wellbore and situating the flow restriction member adjacent a boundary between the first and second subterranean formation zones. The flow restriction member may optionally comprise an auger flight, an orifice plate, an accumulator, and combinations thereof. The method may further comprise inducing connate fluid flow from one of the subterranean formation zones into the wellbore. Inducing connate fluid flow into the wellbore comprises perforating from the wellbore into the subterranean formation zone or conducting perforation cleanout.

DETAILED DESCRIPTION OF THE INVENTION

Figure 2:
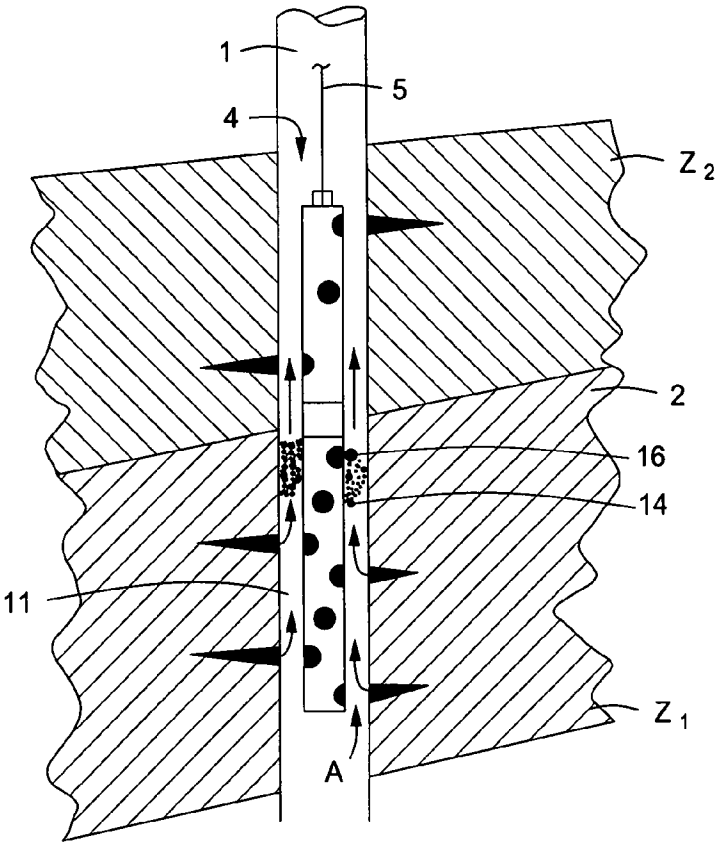
FIG. 2 portrays a partial cutaway side view of a perforating operation with formation fluid flowing into a wellbore.
Figure 1:
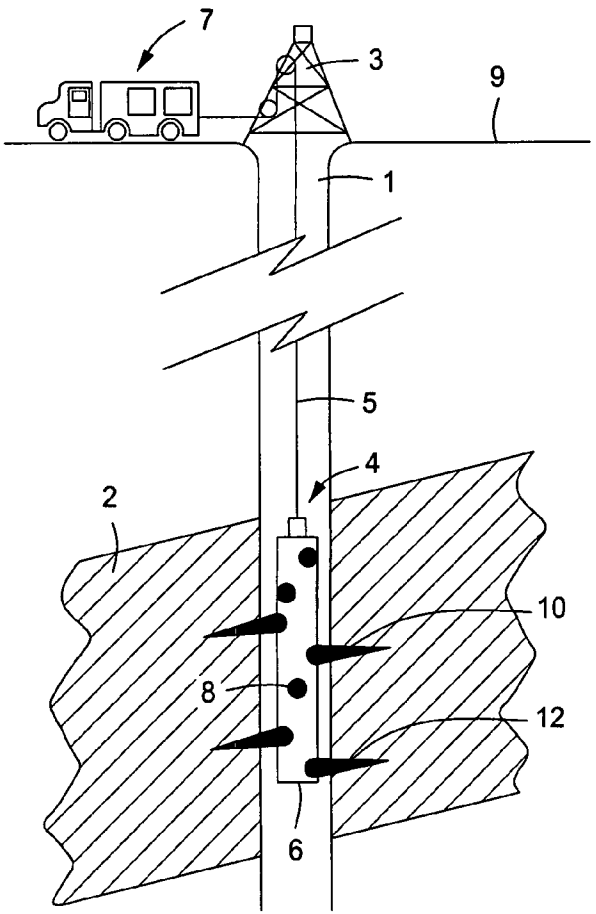
FIG. 1 is a partial cutaway side view of a perforating operation.
Figure 3:
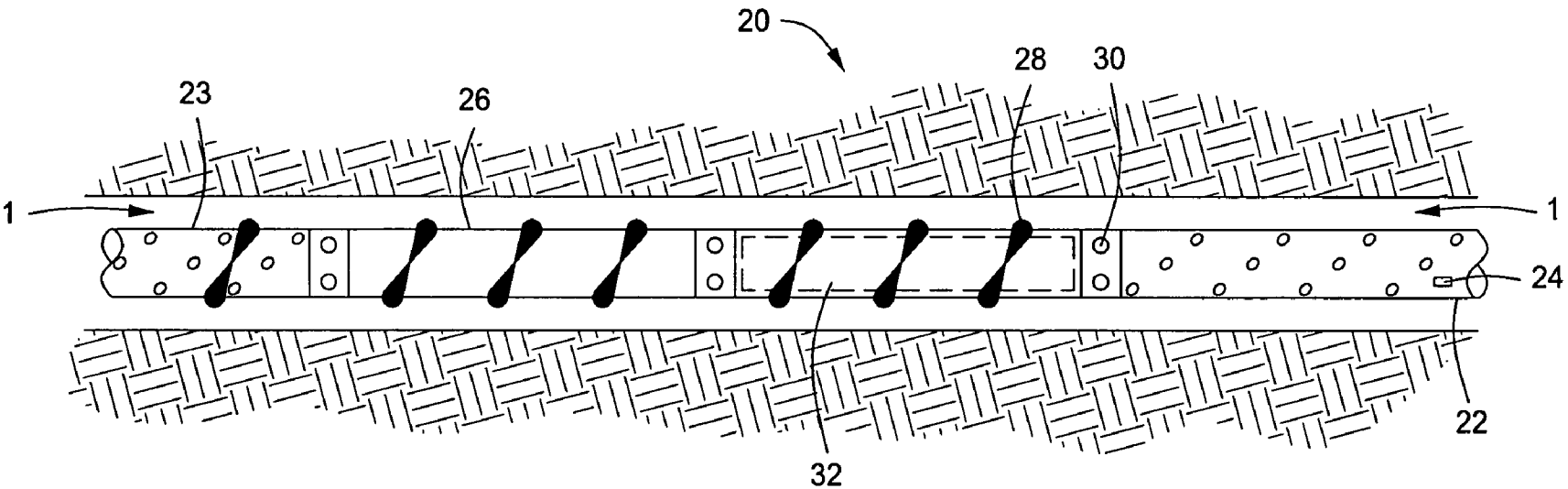
FIG. 3 illustrates a side view of a perforating string in accordance with an embodiment of the present disclosure.

With reference now to FIG. 3 an embodiment of a perforating system in accordance with the present disclosure is illustrated in a side view. In this figure an illustration of the perforating string 20 portion of a perforating system is provided. The perforating string 20 comprises a perforating section 22 axially connected to an accumulator section 26. As shown, an additional perforating section 23 is connected on the end of the accumulator section 26 opposite the perforating section 22. It should be pointed out that the number of perforating sections (or guns) is not limited to the number shown but could be any number of guns included with the perforating string 20 of the present disclosure.

An auger flight 28 is provided along the outer circumference of the perforating string 20. The auger flight 28 is a generally helical member that winds along on the outer circumference of the perforating string 20 along a portion of its length. As shown, the auger flight 28 is disposed primarily along the accumulator section 26 of the perforating string 20. Optionally the auger flight 28 may extend also along one or more of the perforating sections (22, 23) in addition to being along the accumulator section 26. It should be pointed out that the cross section of the auger flight 28 may take one of many different configurations. Typically the base of the auger flight 28 has a wider cross section where it attaches to the perforating string 20 and tapers to a narrower cross section at its outer edge. Other embodiments of the auger flight 28 include a shape where the base and the terminating end have substantially the same thickness with no tapering. However it is well within the scope of those skilled in the art to determine and produce an auger flight suitable for use.

A port 30 is provided on the accumulator section 26, wherein the port 30 may be selectively manipulated into an open or a closed position. When in an open position the port provides fluid communication between the inside and outside of the perforating string 20. Optionally a reservoir 30 (shown in dashed lines) can be provided within the perforating string 20 and in communication with the port 30 such that opening/closing of the port 30 selectively puts the reservoir 30 in fluid communication with the outside of the perforating string 20. The reservoir 32 can be disposed solely within the accumulator section 26 or in some situations could possibly be within one of the perforation sections (22, 23).

In one non-limiting example of operation, a perforating system 4 having an embodiment of the perforating string 20 herein described is lowered within a wellbore 1 to a predetermined depth wherein perforating operations are to be performed. Upon initiation of the shaped charges 24 within the perforating system 4 perforations 10 are formed within the corresponding formation 2. As previously discussed, in an under-balanced situation, formation fluid typically flows from the formation into the wellbore 1 after the perforation sequence. Either simultaneously with initiation of the shape charges 24 or soon thereafter, the ports 30 should be manipulated into an open position. Opening of the ports thereby introduces the reservoir 32 as a potential sink or accumulator for at least a portion of the formation fluid spilling into the wellbore 1. The fluid flowing into the reservoir 32 is not limited to wellbore fluid but can also include all flowable matter resident in the wellbore 1, such as drilling mud, drilling fluid, as well as the producing fluid from the formation 2. Accordingly having the accumulator within the wellbore after perforating provides an open space to absorb potential kinetic energy resulting from the pressure imbalance between the formation 2 and the wellbore 1. Pressure imbalances between the formation 2 and the wellbore 1 may be produced in many ways, such as controlling the wellbore pressure through adjusting wellbore fluid density or by perforating into a formation 2 having a higher pressure than the wellbore 1. Flow into the wellbore 1 from the formation 2 may be induced by perforating into a formation 2 as well as introducing an accumulator within a wellbore 1 having wellbore fluid, wherein the confines of the accumulator are at a lower pressure than the wellbore fluid. Providing fluid communication between the confines of the accumulator and the wellbore 1 can also induce connate fluid flow from the formation 2 into the wellbore 1. As discussed in more detail below, the accumulator in combination with the auger flights can isolate the pressure of one subterranean zone from another.

Figure 4:
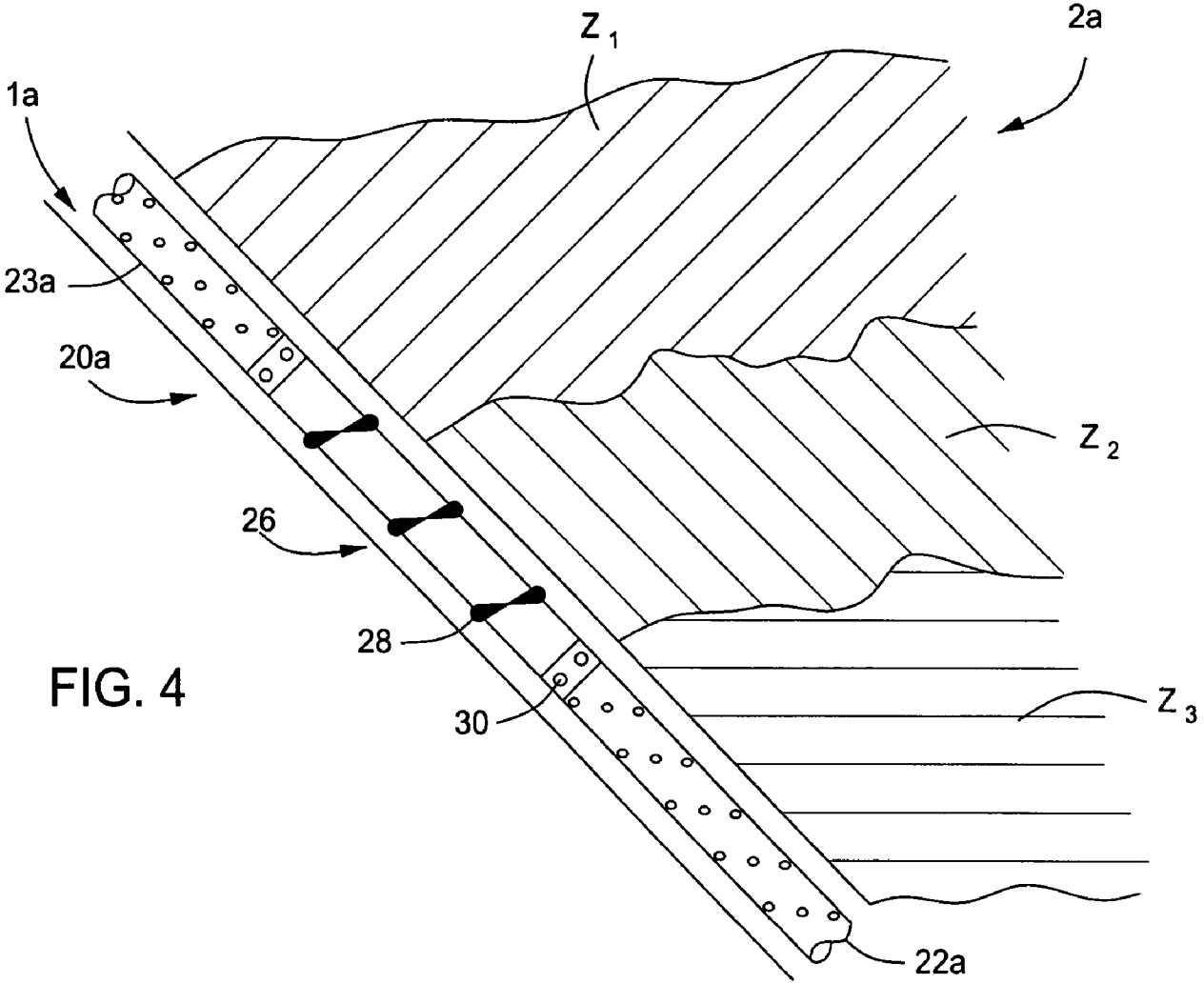
FIG. 4 is a side view of a perforating string in accordance with an embodiment of the present disclosure.

With reference now to FIG. 4, an additional embodiment of the device of the present disclosure is shown disposed within a wellbore 1*a*. In this situation the wellbore 1*a* is shown intercepting different zones ($Z_1$, $Z_2$, $Z_3$,) within a formation 2*a*. Although the embodiment of FIG. 4 is disposed within a deviated portion of a wellbore, the embodiment shown is operable within a substantially vertical section of a wellbore as well as a substantially horizontal portion of a wellbore. In this configuration, the perforating sections (22*a*, 23*a*) are proximate to different zones ($Z_1$, $Z_3$) within the formation 2*a*. This can be significant when the resident pressure of either $Z_1$ or $Z_3$ is sufficiently greater or less than the other zone such that upon perforation the fluid of one zone empties fluid into the wellbore 1*a* with a sufficiently higher pressure that the fluid back flows into the lower pressure zone. The advantages of the device described herein alleviate such a back flow condition due to its flow restriction and pressure absorption capabilities, i.e. the auger flight 28 and reservoir 32. The auger flight 28 restricts flow by reducing the cross sectional area available for fluid flow thereby causing dynamic pressure losses. The reservoir 32, by virtue of fluid communication of the ports 30, can absorb an initial surge of fluid pressure thereby further preventing against such a back flow condition. Accordingly, the present device maintains a fluid pressure differential between adjacent subterranean zones thereby providing zonal isolation between these zones. The zonal isolation, which typically occurs dynamically (dynamic zonal isolation), can be accomplished by the added pressure surge capabilities of the accumulator section, the pressure drop function of the auger flight, as well as a combination of these two.

Figure 5:
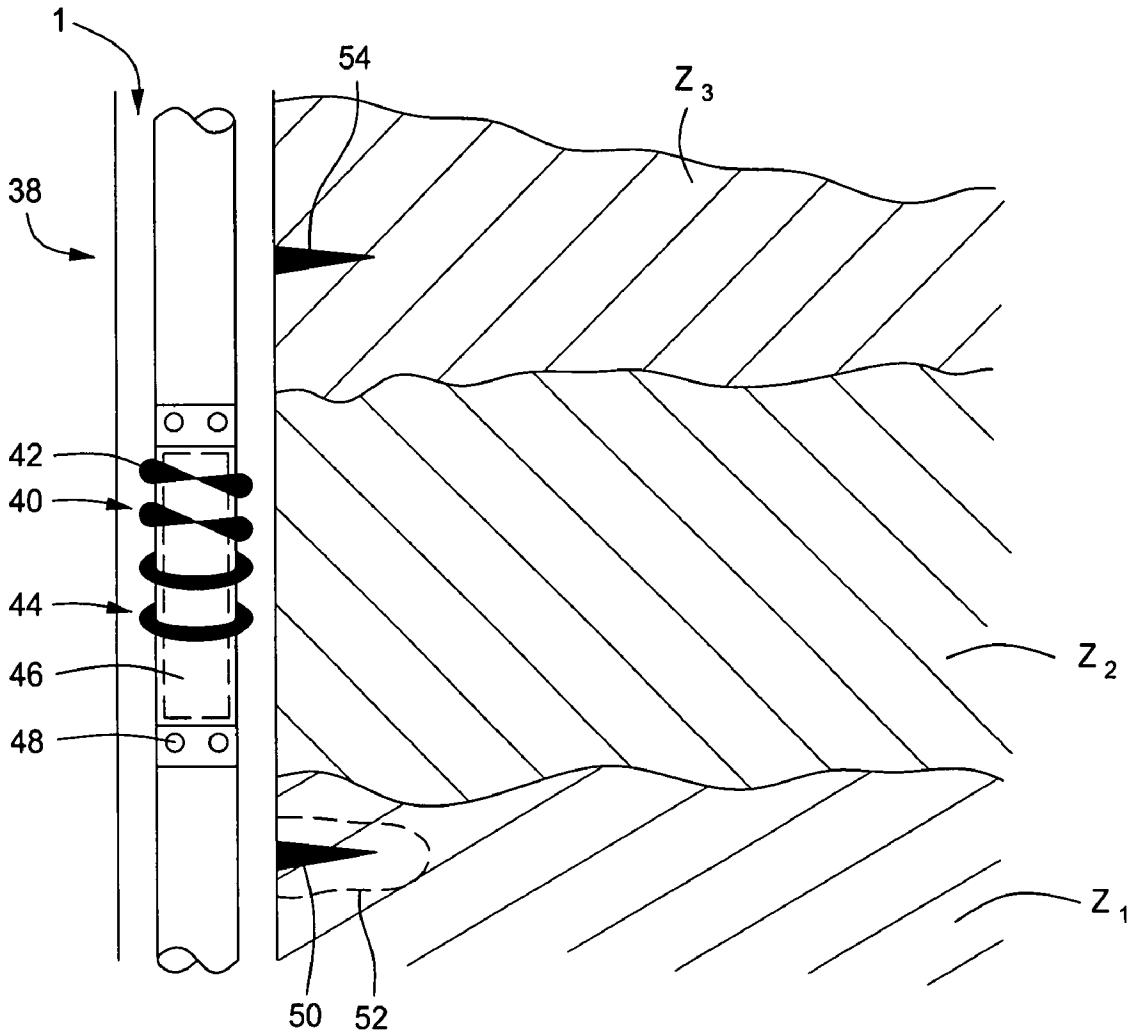
FIG. 5 is a partial cut-away side view of a downhole tool disposed in a wellbore.
Figure 6:
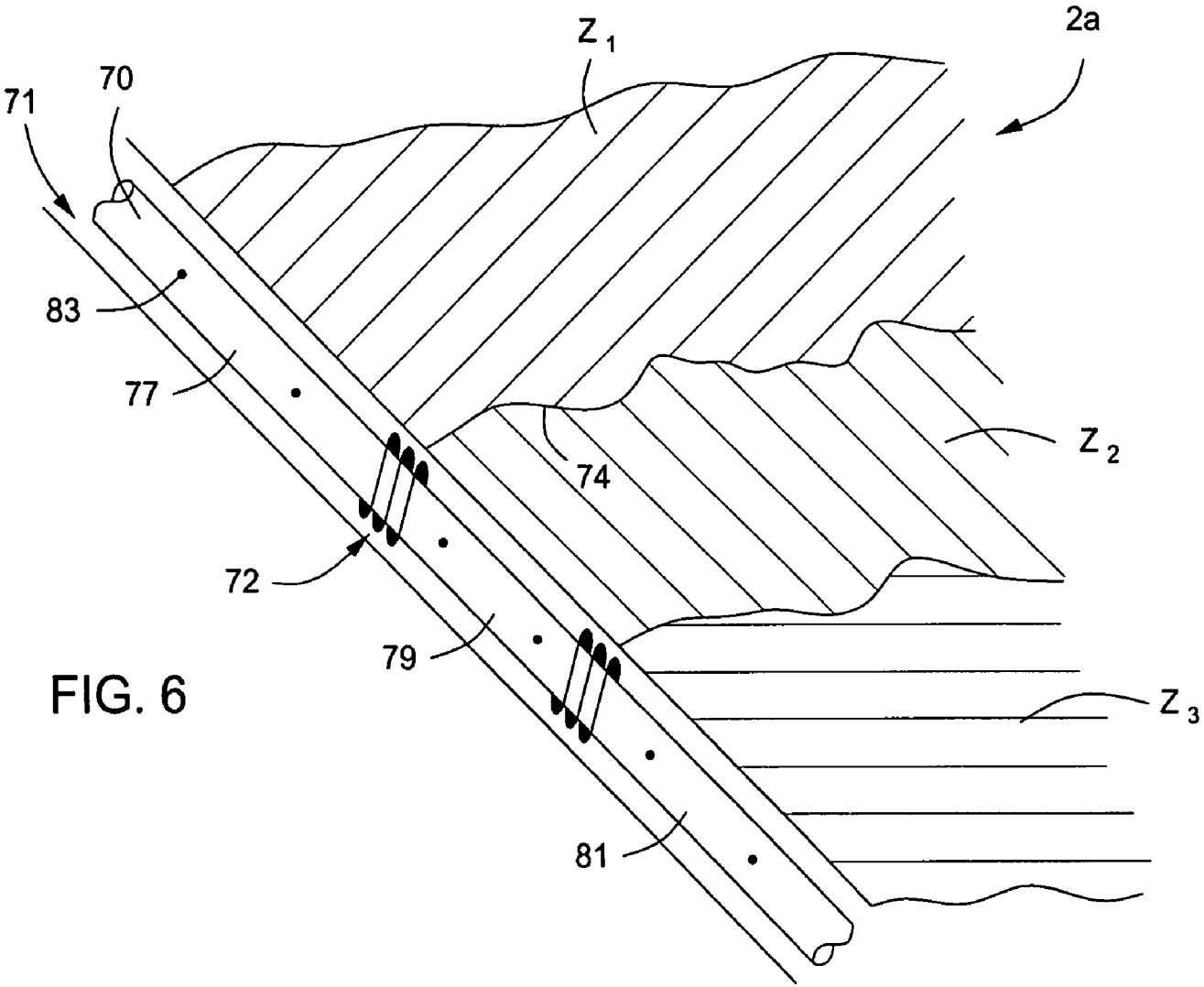
FIG. 6 is a partial cut-away side view of a downhole tool disposed in a wellbore.

Optionally the present device may further allow pressure isolation between various subterranean zones ($Z_1$, $Z_2$, $Z_3$,). For example, one embodiment as shown in FIG. 5 is a downhole tool 70 disposed in a wellbore 71, wherein the wellbore extends through multiple zones ($Z_1$, $Z_2$, $Z_3$,) having differing physical and/or pressure properties. The downhole tool 70 is shown equipped with isolation elements 72, such as an auger flight as described above, disposed at strategic points along its outer surface. The isolation elements 72 include any device extending outward from the surface of the downhole tool 70 for impeding fluid flow in the annulus formed between the inner circumference of the wellbore 71 and the outer circumference of the downhole tool 70. Examples of downhole tools 70 considered include perforating guns (with or without accumulator sections) and perforation surge assemblies. Additionally, the downhole 70 could comprise a series of surge assemblies (77, 79, 81) configured to accommodate a particular zone. Ports 83 (that may be selectively opened) may optionally be included with the surge assemblies to allow flooding of the assemblies. The strategic points should correspond to boundaries (74, 75) between adjacent zones. Thus strategic placement of the downhole tool 70 within the wellbore 71 may control and manipulate pressure surges between adjacent zones via the wellbore 71. The presence of the isolation elements 72 serves to impede fluid flow through the wellbore 71 along the downhole tool 70. Impeding fluid flow in this manner in turn regulates pressure communication between different zones to zonally isolate these zones ($Z_1$, $Z_2$, $Z_3$,).

The scope of the present disclosure is not limited to perforating systems, but can include any tool 38 disposable within a wellbore, such as those used in removing debris from within existing perforations (commonly referred to as a downhole surge assembly). An example of such a device is shown in FIG. 5. This embodiment includes a flow restrictor section 40 for retarding flow across the length of the tool. The flow restrictor section 40 can include surface elements, such as an auger flight 42, a series of orifice plates 44, some other member for retarding flow, or a combination thereof. Although the flow restrictor section 40 shown in FIG. 5 includes more than one type of member for restricting flow, a single member type may be used on the tool 38 for restricting flow. The flow restrictor section 40 thus may comprise any member (flow restriction member) that restricts or otherwise impedes fluid flow axially through the wellbore 1. Optionally, an accumulator 46 (shown as a dashed line) may be included within the tool 38 formed to receive fluid flow therein. Ports 48 may be provided as shown to enable fluid flow from within the wellbore 1 into the accumulator 46. While operation of the device of FIG. 5 would typically not involve the step of perforating, it could occur post perforation. The device could be used to create an underbalanced condition within a wellbore for coaxing connate fluid 52 from a formation $Z_1$ into the wellbore 1. By flowing fluid from the formation $Z_1$ into the wellbore, a perforation orifice 50 connecting that formation $Z_1$ to the wellbore 1 can be cleaned free of any debris that may have accumulated during perforation or thereafter. The flow restrictor section 40 impedes fluids axially flowing through the wellbore 1. As discussed above, the flow restrictor and the fluid accumulator, either separately or in combination, impede fluid flow by reducing the available cross sectional area available for flow (in the case of the flow restrictor) or by absorbing fluid potential energy (by using an accumulator). Impeding fluid flow through the wellbore 1 provides dynamic zonal isolation along the body of the tool 38 thereby isolating subterranean zones from one another. As discussed above, the zonal isolation provided by the tool 38 prevents fluid communication between the zones.

The embodiments described herein, therefore, are well adapted to carry out the objects and attain the ends and advantages mentioned, as well as others inherent therein. While a presently preferred embodiment of an invention has been given for purposes of disclosure, numerous changes exist in the details of procedures for accomplishing the desired results. For example, instead of an auger flight extending partially between the outer surface of a downhole tool and the inner surface of a casing, other flow path restriction members may be employed. Examples of such members include coaxially disposed plates, plates having orifices therethrough, a partially extended packer, as well as any other member for retarding flow across the length of the tool. Further, the downhole conveyance means used for disposing the above described devices includes tubing, cable, wireline, slickline, coiled tubing, casing, and drill pipe. These and other similar modifications will readily suggest themselves to those skilled in the art, and are intended to be encompassed within the spirit of the present invention disclosed herein and the scope of the appended claims.

What is claimed is:

1. A perforating system comprising:

a perforating string;

first and second perforating guns that are spaced apart within the perforation string;

shaped charges in each of the first and second guns; and a zonal isolation system within the perforation string between the first and second perforating guns and comprising a helical member projecting radially outward from an outer surface of and around the perforating string for restricting fluid flow in an annular space between the member and a borehole wall and causes a pressure drop in the fluid flow in the annular space so that the pressure in a fluid flowing from a higher pressure producing zone is reduced in the annular space and does not flow into a lower pressure producing zone.

2. The perforating system of claim 1, wherein the zonal isolation system further comprises an orifice plate.

3. The perforating system of claim 1, further comprising an accumulator section having a reservoir and a port, wherein the accumulator section is located between the first and second perforating portions.

4. The perforating system of claim 1 further comprising a detonation control system in communication with said perforating portion.

5. The perforating system of claim 1, further comprising a downhole conveyance device selected from the group consisting of tubing, cable, wireline, slickline, coiled tubing, casing, and drill pipe.

6. The perforating system of claim 1, further comprising a reservoir disposed between the first and second perforation portions formed to receive a surge of wellbore fluid flow resulting from detonation of the shaped charges.

7. The perforating system of claim 1 further comprising a second zonal isolation system.

8. A perforating system comprising:

a perforating string;

a wireline attached to the string;

a first perforating gun within the string having a shaped charge;

a second perforating gun within the string having a shaped charge that is spaced apart from the first perforating gun; and an auger flight within the string that comprises a member extending radially outward from the perforating string that helically winds between the first and second perforating guns, so that when the perforating system is deployed in a wellbore, the auger flight defines a restricted flow area between the first and second perforating guns, so that when shaped charges in the first and second perforating guns are detonated to form perforations into formation zones adjacent the wellbore, fluid communication between the respective formations is impeded by the auger flight.

9. The downhole tool of claim 8, further comprising an accumulator in the perforating string disposed between the first and second perforating guns.

10. The downhole tool of claim 9, wherein the accumulator comprises a fluid reservoir.

11. The downhole tool of claim 8, further comprising a second zonal isolation system.

12. A method of dynamically isolating flow within a wellbore between a first subterranean formation zone and a second subterranean formation zone that is at a different pressure than the first subterranean formation zone, the method comprising:

providing a downhole tool comprising an outer surface, and a pressure isolation system that has a flow restriction member extending radially outward from the outer surface of the downhole tool and that comprises an auger flight; and disposing the downhole tool within the wellbore so that the member of the pressure isolation system extending radially outward from the downhole tool defines a restricted flow annulus between the member and the wellbore, inducing connate fluid flow from within the first subterranean formation zone;

inducing connate fluid flow from within the second subterranean formation zone; and dynamically creating a pressure drop between the first and second subterranean formation zones of different pressures by locating the restricted flow annulus between the first and second subterranean formation zones and reducing pressure in the connate fluid from the subterranean formation zone having a higher pressure, so that flow from the subterranean formation zone having the higher pressure does not flow into the other subterranean formation zone.

13. The method of claim 12, wherein the pressure isolation system further comprises an orifice plate.

14. The method of claim 12, wherein the downhole tool further comprises an accumulator, the method further comprising restricting fluid flow between the first and second subterranean formation zones by directing fluid into the accumulator.

15. The method of claim 12 wherein the step of inducing connate fluid flow into the wellbore comprises perforating from the wellbore into the subterranean formation zone.

16. The method of claim 12 wherein the step of inducing connate fluid flow into the wellbore comprises conducting perforation cleanout.

17. The method of claim 12, wherein the pressure difference between the first and second subterranean zones is sufficient to induce flow from one of the zones into the other.

* * * * *